US008453737B2

(12) United States Patent
McGlothen et al.

(10) Patent No.: US 8,453,737 B2
(45) Date of Patent: Jun. 4, 2013

(54) DIAMETER BASED TRACKING FOR WINDOW MILLING SYSTEM

(75) Inventors: Jody R. McGlothen, Waxahachie, TX (US); Jeffery R. Acker, Duncanville, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 1619 days.

(21) Appl. No.: 11/458,173

(22) Filed: Jul. 18, 2006

(65) Prior Publication Data

US 2008/0017378 A1 Jan. 24, 2008

(51) Int. Cl.
*E21B 29/06* (2006.01)

(52) U.S. Cl.
USPC ..... 166/298; 166/117.5; 175/80; 175/81

(58) Field of Classification Search
USPC ..... 166/117.5, 117.6; 175/78, 79, 80, 175/81, 82, 83
See application file for complete search history.

(56) References Cited

U.S. PATENT DOCUMENTS

| | | | | |
|---|---|---|---|---|
| 1,608,711 | A * | 11/1926 | Mueller et al. | 166/117.6 |
| 5,771,972 | A | 6/1998 | Dewey | |
| 5,816,324 | A | 10/1998 | Swearingen | |
| 5,826,651 | A | 10/1998 | Lee | |
| 5,894,889 | A | 4/1999 | Dewey | |
| 5,947,201 | A | 9/1999 | Ross | |
| 6,050,334 | A | 4/2000 | McGarian | |
| 6,186,233 | B1 * | 2/2001 | Brunet | 166/298 |
| 6,302,198 | B1 | 10/2001 | Ritorto | |
| 6,499,538 | B2 | 12/2002 | Dewey | |
| 6,612,383 | B2 | 9/2003 | Desai | |
| 6,668,945 | B2 * | 12/2003 | Ohmer | 175/61 |

FOREIGN PATENT DOCUMENTS

| | | |
|---|---|---|
| GB | 2335217 | 9/1999 |
| GB | 2420359 | 5/2006 |
| GB | 2420359 A | 5/2006 |
| WO | 2006/056735 A1 | 6/2006 |

OTHER PUBLICATIONS

UK Search Report issued for GB Patent Application No. 0714024.7 dated Nov. 12, 2007 (3 pages).
Halliburton, "Completion Solutions," undated.
Smith Services, "Trackmaster Plus," dated 2005.
Examination Report issued Jul. 28, 2010, for GB Patent Application 0714024.7, 3 pages.

* cited by examiner

*Primary Examiner* — Shane Bomar
*Assistant Examiner* — Robert E Fuller
(74) *Attorney, Agent, or Firm* — Smith IP Services, P.C.

(57) ABSTRACT

Diameter based tracking for a window milling system. A window cutting system includes a cutting assembly with multiple cutting faces for cutting the window; and a diverter for guiding displacement of the cutting assembly relative to the window, the diverter including multiple separate guide paths for the respective multiple cutting faces. A method of cutting a window includes the steps of: positioning a diverter in a tubular string, the diverter including multiple separate guide paths for respective multiple cutting faces of a cutting assembly; and then contacting the guide paths with the cutting faces to thereby form the window. Another method of cutting a window includes the step of: positioning a diverter in the tubular string, the diverter including multiple separate guide paths for respective multiple cutting faces of a cutting assembly, with each of the guide paths providing a separate wear surface for the respective cutting face.

16 Claims, 6 Drawing Sheets

DIAMETER BASED TRACKING FOR WINDOW MILLING SYSTEM

BACKGROUND

The present invention relates generally to operations performed and equipment utilized in conjunction with a subterranean well and, in an embodiment described herein, more particularly provides diameter based tracking for a window milling system.

In a typical re-entry window milling system, a milling assembly including a lead mill and a follow (or watermelon) mill are deflected laterally relative to a casing or liner string by a milling whipstock. This lateral deflection causes the mills to cut through the casing string to thereby form a window in the casing sidewall. The mills may also be used to drill through cement and/or an earth formation surrounding the casing string, thereby starting a branch wellbore extending outward from the window.

Generally, the lead mill is used to initiate penetration of the casing sidewall, while the follow mill is used to enlarge the window and form it to the desired final shape and dimensions. For reduced resistance to penetration of the casing sidewall, the lead mill may have a smaller diameter than the follow mill, although the mills could have the same diameter. The whipstock deflects both of the mills using the same inclined surface, so that the mills displace along substantially the same path relative to the casing string.

Unfortunately, certain problems arise from use of such prior window milling systems. For example, large bending stresses are experienced when mills having different diameters are guided using the same deflection surface. As another example, substantial wear is experienced when both mills traverse the same surface during the milling operation. Furthermore, prior systems do not take advantage of the unique qualities of the different mills which could be made possible by guiding the mills along respective different paths.

Accordingly, it may be seen that improvements are needed in the art of window milling systems.

SUMMARY

In carrying out the principles of the present invention, a window cutting system and associated methods are provided which solve at least one problem in the art. One example is described below in which the system includes a whipstock or diverter which independently guides the different mills used to cut a window. Another example is described below in which multiple independent guide paths and wear surfaces are formed on the diverter, which is then installed in a well.

In one aspect of the invention, a window cutting system is provided which includes a cutting assembly with multiple cutting faces for cutting the window. A diverter is configured for guiding displacement of the cutting assembly relative to the window. The diverter includes multiple separate guide paths for the respective multiple cutting faces.

In another aspect of the invention, a method of cutting a window through a tubular string in a subterranean well includes the steps of: positioning a diverter in the tubular string, the diverter including multiple separate guide paths for respective multiple cutting faces of a cutting assembly; and then contacting the guide paths with the cutting faces to thereby form the window.

In yet another aspect of the invention, a method of cutting a window through a tubular string in a subterranean well includes the step of: positioning a diverter in the tubular string, the diverter including multiple separate guide paths for respective multiple cutting faces of a cutting assembly, and with each of the guide paths providing a separate wear surface for the respective cutting face.

These and other features, advantages, benefits and objects of the present invention will become apparent to one of ordinary skill in the art upon careful consideration of the detailed description of representative embodiments of the invention hereinbelow and the accompanying drawings, in which similar elements are indicated in the various figures using the same reference numbers.

DETAILED DESCRIPTION

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
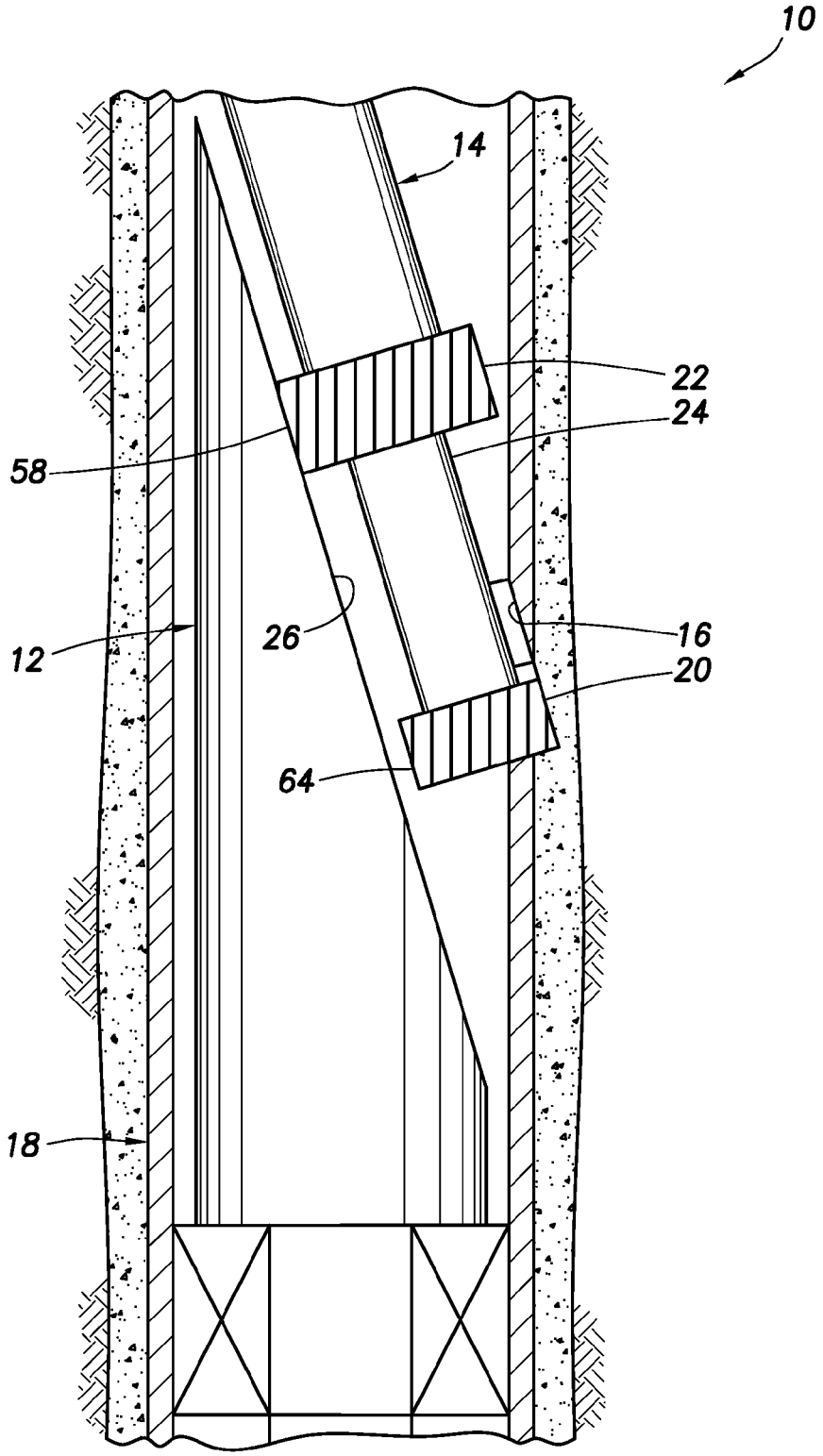
FIG. 1 (PRIOR ART)
FIG. 1 (Prior Art) is a partially cross-sectional view of a known window milling system.

Representatively illustrated in FIG. 1 is a prior art window milling system 10. In the system 10, a whipstock 12 is used to laterally deflect a milling assembly 14, in order to mill a window 16 through a sidewall of a casing string 18. The milling assembly 14 includes a lead mill 20, a follow mill 22 and a tubular extension 24 which spaces apart the two mills.

As depicted in FIG. 1, the lead mill 20 has partially traversed an inclined deflection surface 26 of the whipstock 12, and has been thereby deflected laterally into contact with the casing string 18. As a result, the lead mill 20 has penetrated the sidewall of the casing string 18 to initiate formation of the window 16.

The follow mill 22 has also contacted the inclined surface 26 of the whipstock 12, but has not yet contacted the casing string 18. However, due to the larger diameter of the follow mill 22, this contact between the follow mill and the surface 26 tends to raise the lead mill 20 off of the surface. The contact between the lead mill 20 and the casing string 18 tends to bias the lead mill toward the surface 26.

Thus, it will be appreciated that an undesirable situation results from the use of a single surface 26 to guide the mills 20, 22 toward the casing string 18. Very large bending stresses are induced in the extension 24 due to the deflections of the lead mill 20 relative to the surface 26 when the follow mill 22 contacts the surface. The deflections of the lead mill 20 also cause an irregular, unstable milling of the window 16. Furthermore, in traversing the surface 26, both of the mills 20, 22 cause wear of the same surface, thus requiring that the whipstock 12 be constructed of more expensive wear resistant materials, or that the whipstock be replaced during the milling operation (which is both time-consuming and expensive to accomplish) when the surface is excessively worn.

Figure 2:
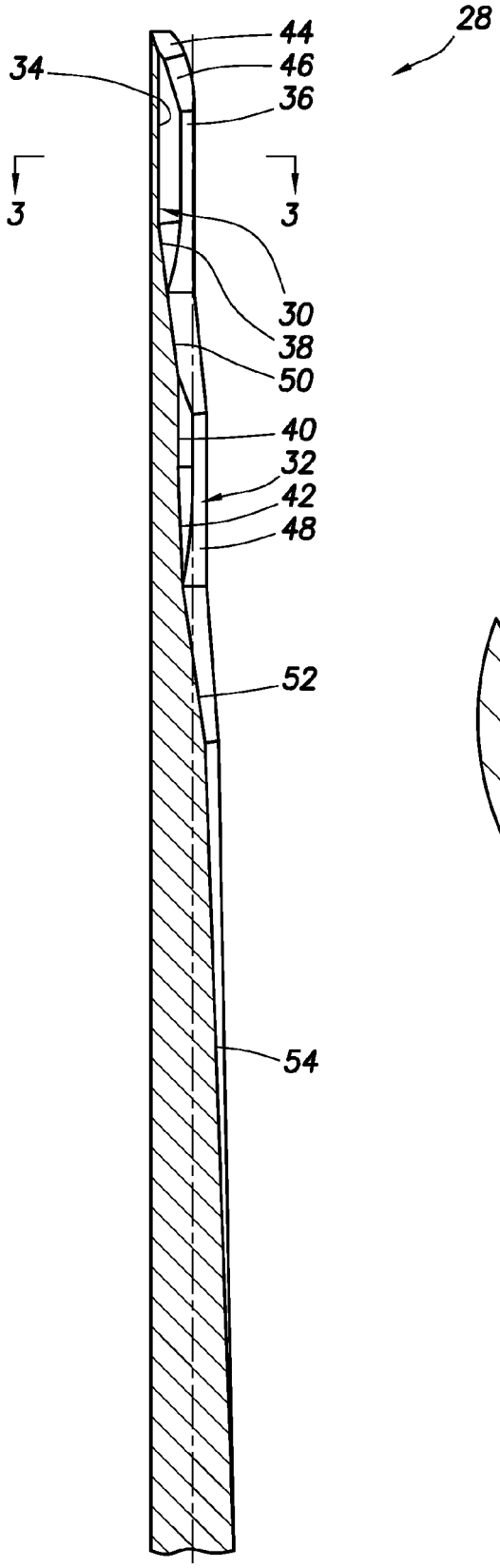
FIG. 2 is an enlarged scale cross-sectional view of a diverter for use in a window cutting system embodying principles of the present invention.

Referring additionally now to FIG. 2, a cross-sectional view of a diverter 28 which embodies principles of the present invention is representatively illustrated. The diverter 28 may be used in place of the whipstock 12 in the system 10 described above.

However, it should be clearly understood that the diverter 28 could be used in other systems in keeping with the principles of the invention. For example, the diverter 28 could be used in window cutting systems in which windows are formed through any type of tubular string, such as liner strings, casing strings, tubing strings, etc. The diverter 28 could be used with window cutting assemblies which include any number, combination and configurations of mills, drills, cutting faces, etc. Thus, the uses of the diverter 28, and the principles of the invention, are not limited in any manner to the details of the system 10 described herein.

One unique feature of the diverter 28 is that it provides multiple guide paths 30, 32 for the respective multiple cutting faces of a cutting assembly. In the example depicted in FIG. 2, the two guide paths 30, 32 correspond to the respective lead mill 20 and follow mill 22 of the milling assembly 14, although it will be appreciated that many other configurations are possible.

Another unique feature of the diverter 28 is that the guide paths 30, 32 enable the mills 20, 22 to be independently guided as they are displaced along the diverter. In turn, this provides the opportunity to utilize the mills 20, 22 in ways not previously possible, for example, to form the window 16 in unique shapes, increase the stability of the mills during the cutting operation, increase the efficiency of the cutting operation, etc.

Yet another unique feature of the diverter 28 is that the guide paths 30, 32 provide separate wear surfaces for the respective mills 20, 22. As described more fully below, the guide paths 30, 32 may include intersecting portions at which the mills 20, 22 traverse the same surface, but in the example depicted in FIG. 2, the guide paths are at least in part independent of each other.

Figure 3:
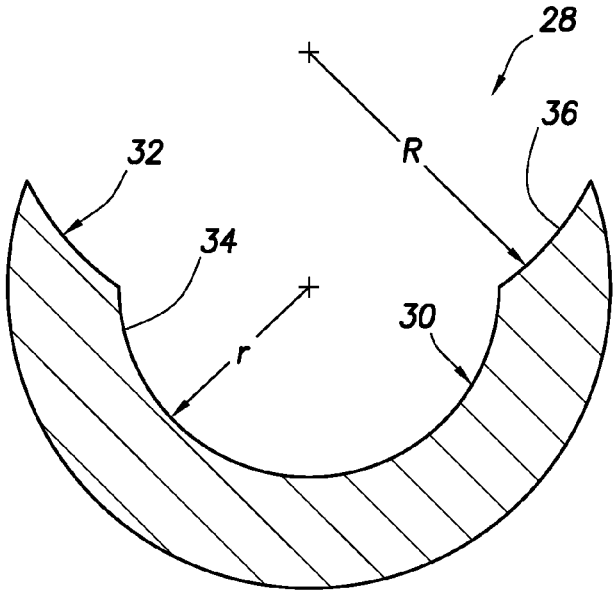
FIG. 3 is an enlarged scale schematic cross-sectional view of the diverter, taken along line 3-3 of FIG. 2.

The paths 30, 32 separately guide the mills 20, 22 due to the difference in the diameters of the mills. In FIG. 3, an enlarged scale lateral cross-sectional view of the diverter 28 is representatively illustrated, in which the difference in curvature of the guide paths 30, 32 may be clearly seen.

The path 30 includes a surface 34 having concave curvature at radius r corresponding to the diameter of the lead mill 20, whereas the path 32 includes a surface 36 having a concave curvature at a larger radius R corresponding to the larger diameter of the follow mill 22. A result of this difference in curvature is that the lead mill 20 will contact and be guided by the surface 34, while the follow mill 22 will contact and be guided by the surface 36.

It is not necessary for the radius r to be exactly half of the diameter of the lead mill 20, or for the radius R to be exactly half of the diameter of the follow mill 22. For example, the radius r could be somewhat greater than the radius of the lead mill 20, but less than the radius of the follow mill 22, while the radius R could be somewhat greater than the radius of the follow mill.

Figure 4:
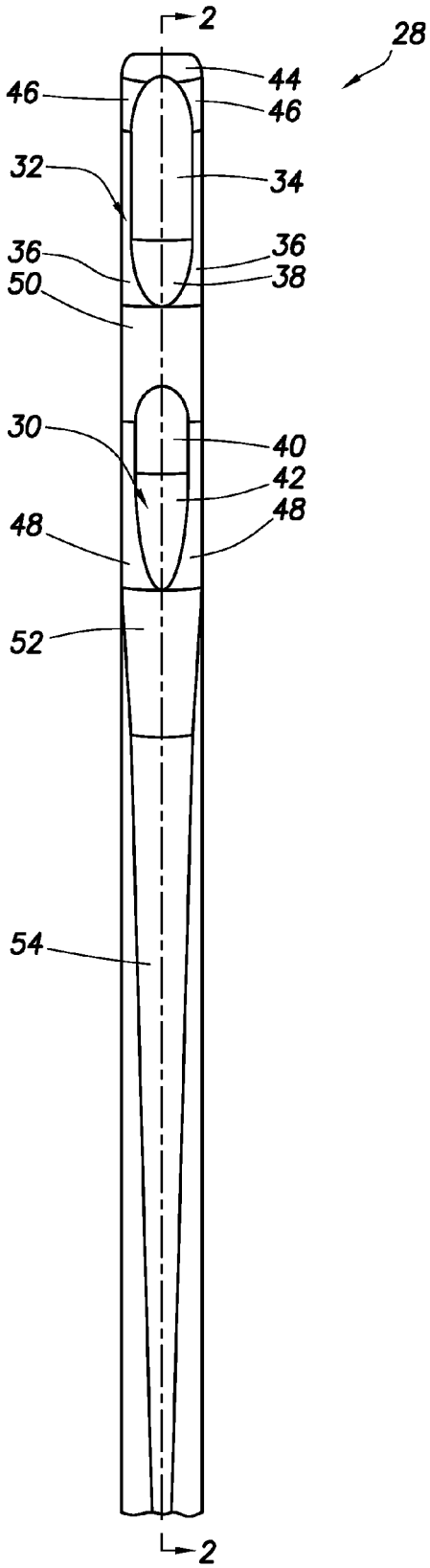
FIG. 4 is an elevational view of the diverter.

An elevational view of the diverter 28 is representatively illustrated in FIG. 4. In this view the various surfaces which make up the guide paths 30, 32 may be clearly seen.

The surfaces 34, 38, 40, 42 have a relatively small curvature (corresponding to the smaller diameter of the lead mill 20) and are only contacted by the lead mill. The surfaces 36, 44, 46, 48 have a relatively large curvature (corresponding to the larger diameter of the follow mill 22) and are only contacted by the follow mill. The surfaces 50, 52, 54 are designed to be contacted by both of the lead and follow mills 20, 22.

Thus, the guide path 30 for the lead mill 20 includes the surfaces 34, 38, 50, 40, 42, 52, 54, and the lead mill will traverse these surfaces in that order. The guide path 32 for the follow mill 22 includes the surfaces 44, 46, 36, 50, 48, 52, 54, and the follow mill will traverse these surfaces in that order. Note that the guide paths 30, 32 intersect at the surfaces 50, 52, 54.

In one unique feature of the guide paths 30, 32 as configured in FIG. 4, the lead mill 20 contacts and is deflected laterally outward by the surface 38 at the same time that the follow mill 22 contacts and is deflected laterally outward by the surface 46. In this manner, both of the mills 20, 22 are laterally supported by the diverter 28 when they contact and cut through the casing string 18. This lateral support is also provided by the diverter 28 for both of the mills 20, 22 when they are traversing the respective surfaces 40, 36 which are not laterally inclined and do not deflect the mills outward.

It may now be more fully appreciated how the use of different guide paths enables enhanced shaping of windows. For example, the lead mill 20 may be deflected laterally at a different point along the diverter 28 as compared to the lateral deflection of the follow mill 22. As another example, one of the mills 20, 22 may traverse a surface which is not laterally inclined at a point on the diverter 28 where the other mill traverses a surface which is laterally inclined (e.g., the surface 38 traversed by the lead mill is laterally inclined at a point longitudinally along the diverter where the surface 36 traversed by the follow mill is not laterally inclined).

This ability to independently deflect and guide the cutting faces of the mills 20, 22 opens up a wide variety of possibilities for creating uniquely shaped windows. Furthermore, the multiple guide paths 30, 32 provide increased support to the mills 20, 22 during the cutting operation (for example, the lead mill 20 can be supported by the guide path 32 while the follow mill 22 simultaneously contacts and is guided by the path 30), which reduces bending stresses in the extension 24, and the multiple guide paths can increase the stability of the mills during the cutting operation. These features are of substantial benefit especially when both of the mills 20, 22 are cutting through the casing string 18, and also when only the lead mill is cutting through the casing string.

Figure 5:
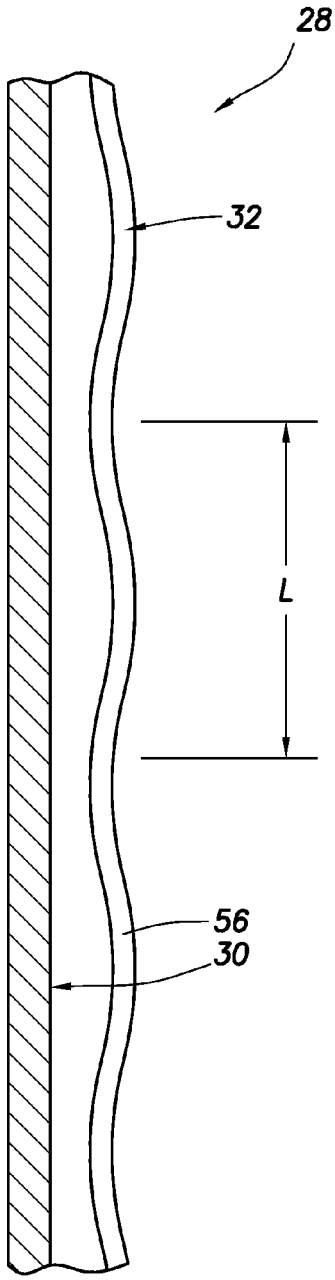
FIG. 5 is a schematic cross-sectional view of a first alternate configuration of the diverter.

Referring additionally now to FIG. 5, a schematic cross-sectional view of a longitudinal portion of an alternate configuration of the diverter 28 is representatively illustrated. In this view it may be seen that the guide path 32 includes an undulating surface 56. For example, the surface 56 may have a sinusoidal shape with a period of length L.

Preferably, the period L of the surface 56 is less than the length of an outer cutting face 58 of the follow mill 22. In this manner, the cuts made by the cutting face 58 will overlap along the length of the window 16, producing a substantially constant width of the window. However, it is not necessary for the surface 56 to be shaped so that the cuts made by the cutting face 58 overlap, since in some circumstances it may be desired to produce windows with other than constant widths.

One benefit of using the undulating surface 56 in the guide path 32 is that it produces a lateral oscillating (in-and-out) displacement of the follow mill 22 relative to the casing string 18 as the follow mill traverses the surface. It is known that when the centerline of the follow mill 22 is inline with the sidewall of the casing string 18, an unstable situation results. The oscillating motion of the follow mill 22 produced by the surface 56 permits the follow mill to displace back and forth through the sidewall of the casing string 18, cutting a width of the window 16 at least as great as the diameter of the follow mill along a substantial length of the window, without the follow mill centerline having to remain inline with the sidewall of the casing string for any substantial amount of time.

In addition, note that the guide path 30 as depicted in FIG. 5 does not include a surface which also produces a similar oscillating motion of the lead mill 20. This is due to the fact that the guide paths 30, 32 are independent of each other. However, it should be understood that the guide path 30 could include a surface which produces an oscillating motion of the lead mill 20 in keeping with the principles of the invention.

Figure 6:
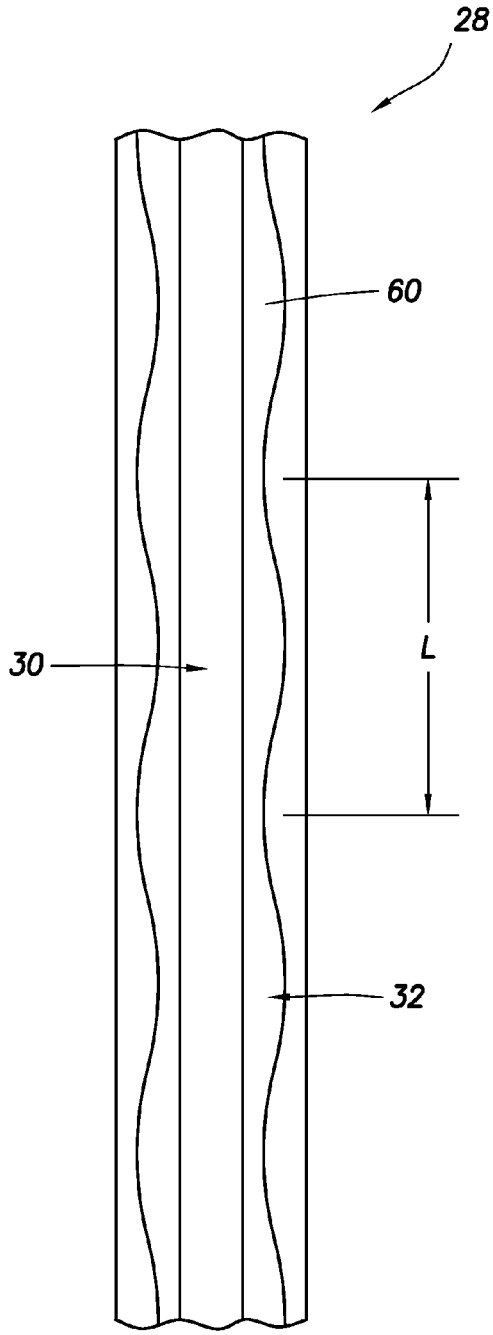
FIG. 6 is a schematic cross-sectional view of a second alternate configuration of the diverter.

Referring additionally now to FIG. 6, a schematic elevational view of a longitudinal portion of another alternate configuration of the diverter 28 is representatively illustrated. In this view it may be seen that the guide path 32 includes an undulating surface 60. For example, the surface 60 may have a sinusoidal shape with a period of length L.

The surface 60 is similar to the surface 56 described above, except that it produces a lateral oscillating motion of the follow mill 22 which is orthogonal to that produced by the surface 56. In other words, the surface 56 produces an in-and-out motion of the follow mill 22 relative to the sidewall of the casing string 18, whereas the surface 60 produces a side-to-side motion of the follow mill relative to the casing string sidewall.

The surface 60 may have a sinusoidal shape with a period of length L which, similar to the surface 56 as described above, produces an overlapping of the cuts generated by the cutting face 58. In this manner, the width of the window 16 can be greater than the diameter of the follow mill 22, even where the centerline of the follow mill is not inline with the sidewall of the casing string 18. It will be appreciated by those skilled in the art that this is a substantial benefit in the art of window milling, at least in part because access and flow through the window 16 is enhanced by the increased width, and a smaller diameter mill may be used for a given window width (thereby reducing the torque required to drive the mill and increasing the efficiency of the cutting operation).

However, it should be understood that it is not necessary for the cuts made by the follow mill 22 to overlap in the manner described above. For example, it may be desirable in some situations for the cuts to not overlap, or to only partially overlap, to thereby produce other desired shapes of the window 16.

In addition, note that the guide path 30 as depicted in FIG. 6 does not include a surface which also produces a similar side-to-side oscillating motion of the lead mill 20. This is due to the fact that the guide paths 30, 32 are independent of each other. However, it should be understood that the guide path 30 could include a surface which produces an oscillating motion of the lead mill 20 in keeping with the principles of the invention.

It may be desirable to combine the displacements produced by the surfaces 56, 60 described above. For example, the guide path 32 could include a surface which is helically formed and thereby produces both an in-and-out and side-to-side motion of the follow mill 22 as it traverses the surface. The guide path 30 could include such a surface for producing a similar motion of the lead mill 20, as well.

Figure 7:
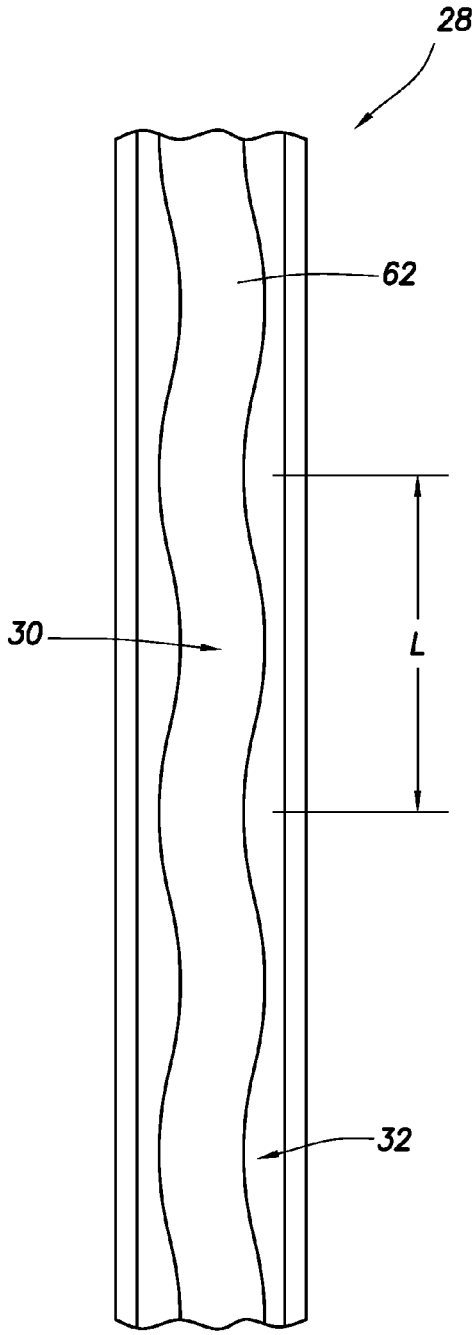
FIG. 7 is a schematic cross-sectional view of a third alternate configuration of the diverter.

An alternate configuration of the diverter 28 as depicted in FIG. 7 demonstrates one manner in which the guide path 30 can include a surface 62 which produces an oscillating displacement of the lead mill 20. In this example, the surface 62 has a sinusoidal shape with a period of length L which is less than the length of an outer cutting face 64 of the lead mill 20. This configuration enables the lead mill 20 to cut through the sidewall of the casing string 18 and produce an initial opening which has a greater width than the diameter of the lead mill.

It will be appreciated that the guide path 30 can also be configured with surfaces which produce a side-to-side motion of the lead mill 20, a combination of in-and-out and side-to-side motions, or any other type or combination of displacements. In addition, the guide paths 30, 32 may produce any displacements of the mills 20, 22 separately and independently of each other. This enables any desired shape of the window 16 to be formed, and allows the unique capabilities of each of the mills 20, 22 to be utilized to their greatest extent, among other benefits.

Figure 8:
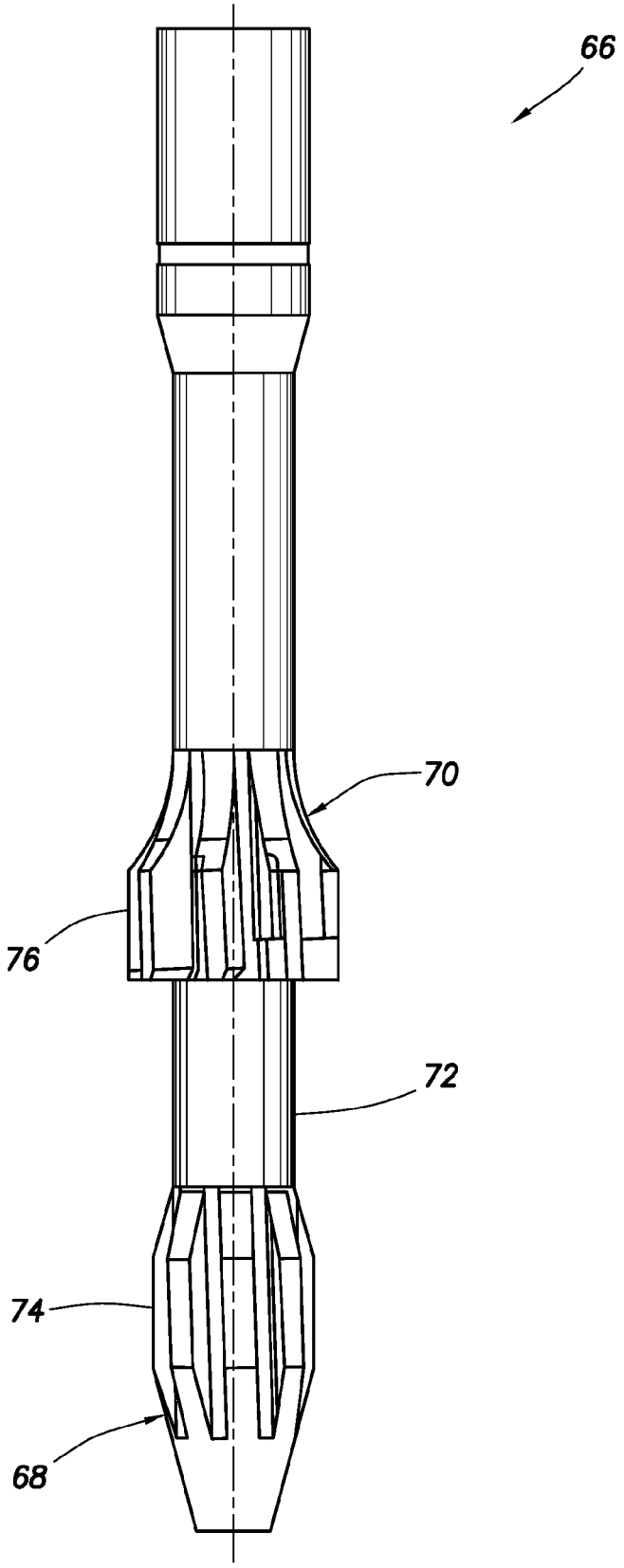
FIG. 8 is an elevational view of a cutting assembly for use in the window cutting system.

Referring additionally now to FIG. 8, an elevational view of a cutting assembly 66 which embodies principles of the present invention is representatively illustrated. The cutting assembly 66 may be used in place of the milling assembly 14 in the system 10 described above.

However, it should be clearly understood that the cutting assembly 66 could be used in other systems in keeping with the principles of the invention. For example, the cutting assembly 66 could be used in window cutting systems in which windows are formed through any type of tubular string, such as liner strings, casing strings, tubing strings, etc. The cutting assembly 66 could be used with any whipstocks or diverters which include any number, combination and configurations of surfaces, etc. Thus, the uses of the cutting assembly 66, and the principles of the invention, are not limited in any manner to the details of the system 10 described herein.

As depicted in FIG. 8, the cutting assembly 66 is a one-piece structure which includes a lead mill 68, a follow mill 76 and an extension 72 which spaces apart the two mills. The lead mill 68 includes an outer cutting face 74 which has a smaller diameter than an outer cutting face 76 of the follow mill 70. A bore (not visible in FIG. 8) extends longitudinally through the cutting assembly 66.

Note that the lead mill 68 includes multiple angled blades. Each blade is symmetric and includes multiple faces, one of which is parallel with the longitudinal axis of the lead mill 68.

The follow mill 76 also includes multiple angled blades, each of which has multiple faces, one of which is perpendicular to the longitudinal axis of the follow mill. A trailing face of the follow mill 76 has a concave generally frusto-conical profile and has a smaller diameter than that of the lead mill 68.

The one-piece construction of the cutting assembly 66 provides a very rigid structure which is also very strong due to the absence of threads, etc. joining the various components of the assembly to each other. However, it should be understood that cutting assemblies utilizing separately formed components may be used in keeping with the principles of the invention.

Figure 9:
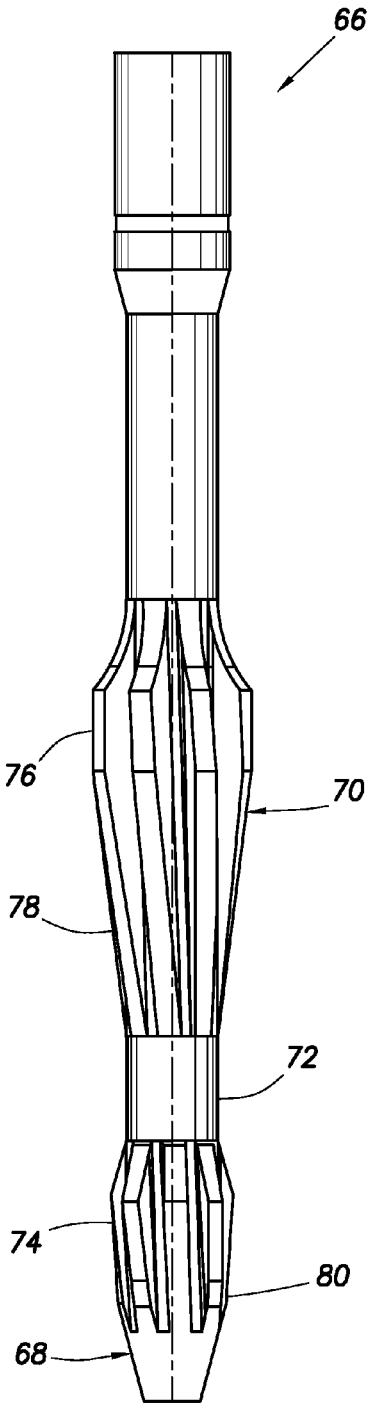
FIG. 9 is an elevational view of a first alternate configuration of the cutting assembly.

An alternate configuration of the cutting assembly 66 is representatively illustrated in FIG. 9. In this configuration, the follow mill 70 includes an inclined or tapered leading cutting face 78. In addition, the lead mill 68 includes a leading inclined cutting face 80 and the cutting face 74 is also inclined.

The lead mill 68 includes multiple angled blades. Each blade is symmetric and includes multiple faces, all of which are inclined relative to the longitudinal axis of the lead mill 68. The leading cutting face 80 is inclined to match the angle of the surface 42 of the diverter 28.

The follow mill 76 also includes multiple angled blades, each of which has multiple faces, all of which are inclined relative to the longitudinal axis of the follow mill. The leading cutting face 78 is inclined to match the angle of the surface 38 of the diverter 28. Thus, when the cutting faces 80, 78 simultaneously traverse the respective surfaces 42, 38 of the diverter 28, the cutting assembly 66 is displaced laterally outward, while the longitudinal axis of the cutting assembly remains parallel to the longitudinal axis of the diverter.

Therefore, it will be appreciated that any configuration of the cutting assembly 66 may be used in keeping with the principles of the invention. For example, any number, placement, type and combinations of cutting faces may be used, any of the cutting faces (e.g., the leading face) on the lead mill 68 and/or follow mill 70 may include blades, cutters, etc.

Figure 10:
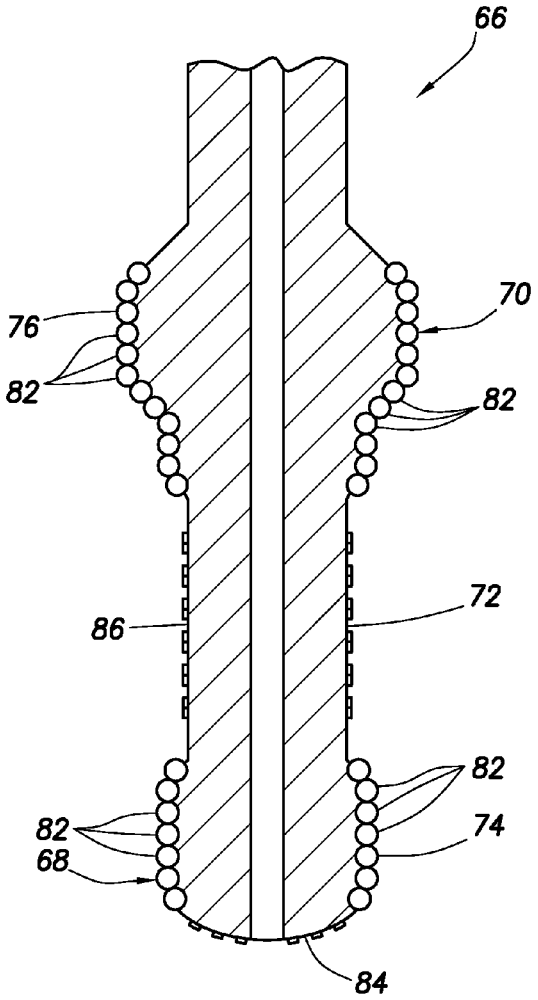
FIG. 10 is an elevational view of a second alternate configuration of the cutting assembly.

As yet another example, depicted in FIG. 10 is another alternate configuration of the cutting assembly 66, schematically illustrated in a cross-sectional view. In this configuration, the respective cutting faces 74, 76 of lead and follow mills 68, 70 are made up of an array of individual cutting teeth or elements 82, such as carbide "buttons."

In addition, an end surface 84 of the lead mill 68 and an outer surface 86 of the extension 72 are covered with a cutting material. A suitable cutting material for use on the surfaces 84, 86 is known as CUTRITE™, and is available from Halliburton Energy Services, Inc. of Houston, Tex., USA.

The use of the cutting material on the surfaces 84, 86 allows the sidewall of the casing string 18 to be cut by portions of the cutting assembly 66 other than the lead and follow mills 68, 70. Indeed, since substantially all of the lower portion of the cutting assembly 66 is capable of cutting the sidewall of the casing string 18, it may be considered that the lead and follow mills 68, 70 are not really separate components of the cutting assembly or separate "mills"—instead, the cutting assembly may be considered as being made up of multiple cutting faces. These multiple cutting faces may be independently guided by a whipstock or diverter, as described above.

In a method which incorporates principles of the invention, a window (such as the window 16) is cut through a tubular string (such as the casing string 18) in a subterranean well. A diverter (such as the diverter 28) is positioned in the tubular string. When so positioned, the diverter includes multiple separate guide paths (such as the guide paths 30, 32) for respective multiple cutting faces (such as the cutting faces 74, 76) of a cutting assembly (such as the cutting assembly 66). Then, the guide paths are contacted by the cutting faces to thereby form the window. The guide paths are able to independently guide the cutting faces to form the window.

Of course, a person skilled in the art would, upon a careful consideration of the above description of representative embodiments of the invention, readily appreciate that many modifications, additions, substitutions, deletions, and other changes may be made to these specific embodiments, and such changes are within the scope of the principles of the present invention. Accordingly, the foregoing detailed description is to be clearly understood as being given by way of illustration and example only, the spirit and scope of the present invention being limited solely by the appended claims and their equivalents.

What is claimed is:

1. A window cutting system, comprising:

a cutting assembly including multiple cutting faces for cutting the window; and a diverter for guiding displacement of the cutting assembly relative to the window, the diverter including multiple separate guide paths for the respective multiple cutting faces, at least one guide path being laterally offset from another guide path at a same longitudinal position along the diverter.

2. The system of claim 1, wherein the guide paths are independent of each other, so that the cutting faces are independently guided along the diverter.

3. The system of claim 1, wherein at least a portion of the guide paths intersects, so that the cutting faces are each guided by the intersecting portion.

4. The system of claim 1, wherein each of the guide paths has a concave curvature which corresponds to a diameter of the respective cutting face.

5. The system of claim 1, wherein the cutting faces simultaneously contact the respective guide paths.

6. The system of claim 1, wherein the guide paths provide separate wear surfaces for the respective cutting faces.

7. The system of claim 1, wherein at least one of the guide paths causes the respective cutting face to oscillate as the cutting face traverses the guide path.

8. A method of cutting a window through a tubular string in a subterranean well, the method comprising the steps of:

positioning a diverter in the tubular string, the diverter including multiple separate guide paths for respective multiple cutting faces of a cutting assembly, at least one guide path surface being laterally adjacent to another guide path surface on the diverter; and then contacting the guide paths with the cutting faces to thereby form the window.

9. The method of claim 8, wherein the contacting step further comprises each of the cutting faces simultaneously contacting the respective guide path and the tubular string.

10. The method of claim 8, wherein the contacting step further comprises each of the cutting faces simultaneously contacting the respective guide path and cutting through the tubular string.

11. The method of claim 8, wherein the positioning step further comprises the guide paths providing multiple wear surfaces for the respective multiple cutting faces.

12. The method of claim 8, further comprising the step of providing each of the guide paths including a concave curvature which corresponds to a diameter of the respective cutting face.

13. The method of claim 8, wherein the contacting step further comprises at least one of the guide paths causing the respective cutting face to oscillate as the cutting face traverses the guide path.

14. A method of cutting a window through a tubular string in a subterranean well, the method comprising the steps of:

positioning a diverter in the tubular string, the diverter including multiple separate guide paths in at least one lateral cross-sectional plane through the diverter for respective multiple cutting faces of a cutting assembly, each of the guide paths providing a separate wear surface for the respective cutting face; and cutting the window.

15. The method of claim 14, wherein the positioning step further comprises each of the guide paths including a concave curvature which corresponds to a diameter of the respective cutting face.

16. The method of claim 14, wherein the cutting faces have different diameters.

* * * * *